US006541717B1

(12) United States Patent
Roberts

(10) Patent No.: US 6,541,717 B1
(45) Date of Patent: Apr. 1, 2003

(54) LOCKING ASSEMBLY FOR A SWITCH ASSEMBLY

(75) Inventor: Gerald B. Roberts, Paris, MO (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/989,705

(22) Filed: Nov. 21, 2001

(51) Int. Cl.[7] ..... H01H 9/00; H01H 31/00

(52) U.S. Cl. ..... 200/43.11; 200/43.04; 200/17 R; 200/331; 200/48 R; 200/48 A; 218/12

(58) Field of Search ..... 81/53.1; 200/17 R, 200/331, 43.11, 43.04; 218/1, 12; 294/19.1, 19.3, 24, 26; 439/476.1, 477, 478, 480, 483, 484

(56) References Cited

U.S. PATENT DOCUMENTS

| | | | | |
|---|---|---|---|---|
| 2,169,860 A | | 8/1939 | Von Hoorn | 70/203 |
| 3,327,075 A | | 6/1967 | Phillipson | 200/42 |
| 3,426,164 A | | 2/1969 | Dessert | 200/42 |
| 4,013,852 A | * | 3/1977 | Roberts et al. | 218/12 |
| 4,203,083 A | * | 5/1980 | Opfer et al. | 335/174 |
| 4,260,861 A | | 4/1981 | DiMarco | 200/42 T |
| 4,412,202 A | * | 10/1983 | Russell et al. | 337/171 |
| 4,681,990 A | * | 7/1987 | Osborne | 200/48 KB |
| 4,707,574 A | * | 11/1987 | Smith | 200/48 KB |
| 5,260,528 A | | 11/1993 | Benda | 200/43.14 |
| 5,268,543 A | * | 12/1993 | Ramos | 200/43.11 |
| 5,274,349 A | * | 12/1993 | Hassler et al. | 337/171 |
| 5,451,730 A | | 9/1995 | Phillips, Sr. | 200/43.11 |
| 5,467,622 A | | 11/1995 | Becker et al. | 70/203 |
| 5,821,486 A | * | 10/1998 | Paw et al. | 200/48 A |
| 6,130,391 A | | 10/2000 | Taylor | 200/331 |
| 6,459,053 B1 | * | 10/2002 | Roberts | 200/48 R |

* cited by examiner

*Primary Examiner*—Michael Friedhofer
(74) *Attorney, Agent, or Firm*—Marcus R. Mickney; Mark S. Bicks; Alfred N. Goodman

(57) ABSTRACT

A hookstick operated switch assembly includes a switch mounted to a support and movable between open and closed positions. An operating lever is connected to the switch for opening and closing the switch. A locking arm is positioned proximal the switch. A locking member is receivable by the locking arm when the switch is in the open position to prevent movement of the operating lever, thereby locking the switch in the open position.

29 Claims, 7 Drawing Sheets

LOCKING ASSEMBLY FOR A SWITCH ASSEMBLY

CROSS REFERENCE TO RELATED APPLICATION

This application is related to U.S. patent application Ser. No. 09/457,593 of Gerald B. Roberts, entitled "Overtoggled Interrupter Switch Assembly" and filed Dec. 9, 1999, the subject matter of which is hereby incorporated by reference.

FIELD OF THE INVENTION

The present invention relates to a locking assembly for a switch assembly. More particularly, the present invention relates to a locking assembly for an over-head hook-stick operated switch assembly. The locking assembly has a locking member that prevents an operating lever from closing a switch of the switch assembly.

BACKGROUND OF THE INVENTION

Overhead electric power distribution lines are supported on utility poles having a height of up to 50 feet. Supports mounted to the pole often carry various electrical distribution lines. Because such electrical distribution lines commonly operate in a three-phase system with three lines mechanically connected to the horizontal support and electrically insulated from each other, three associated lines ordinarily must be switched and reconnected simultaneously for maintenance or rerouting of power in case of a fault. This simultaneous switching process requires a group operated switch system.

Currently, many high voltage switch assemblies for overhead power distribution lines are open and closed by a field technician using a hookstick. The hookstick engages an operating lever connected to a universal control section securely connected to the rotatable switch phase bearing. Rotation of the bearing is translated into lateral displacement of an interphase shaft along the horizontal support beam. Conductive switch blades on each switch phase connection may be rotated into or out of electrical connection with the respective phase line. Pulling a hook on the operating lever with the hookstick rotates the control shaft, which rotates the switch phases. Load interrupters suppress the formation of damaging arcs as the switch blades are opened.

High voltage overhead power switches are typically mounted well above ground and experience a variety of externally applied forces, such as weather, wild animals, vandalism, utility pole deformation, and vibration, that may cause a switch blade to move or close unintentionally. Furthermore, if a switch blade moves close enough to a contact, flashover may occur. The operating lever must maintain the security required to prevent unintended closing or movement of the conductive blades. Therefore, a need exists for an overhead switch assembly having a locking assembly to prevent accidental closing of the switch blades.

A typical phase group operated switch assembly installation includes at least one support beam mounted to an upright pole. The support beam supports the phases and conductor tension dead ending. Periodic inspection and maintenance is required to prevent against premature wear or damage to the switch assembly due to loss of proper adjustment caused by such adverse conditions as vibration, weathering of support components, wild animals, vandalism and dimensional changes in the utility pole (e.g., twisting). Accidental closing of the switch blades during a maintenance period may cause equipment damage, loss of electrical service and personnel injury. Therefore, a need exists for a locking assembly that clearly indicates to a person on the ground that the switches of the switch assembly are locked in an open position.

A need exists for a locking assembly for a hookstick operated switch assembly that secures a switch of the switch assembly in an open position to perform maintenance on the electrical system, while being removable to close the switch and return the electrical system to normal operating conditions.

SUMMARY OF THE INVENTION

Accordingly, it is a primary objective of the present invention to provide a locking assembly for a hookstick operated switch assembly to prevent unintentional movement and closing of a switch.

A further objective of the present invention is to provide a locking assembly that indicates to personnel on the ground that a switch of a switch assembly is in a locked open position.

The foregoing objects are basically attained by providing a hookstick operated switch assembly including a switch mounted to a support that is movable between open and closed positions. An operating lever is connected to the switch for opening and closing the switch. A locking arm is attached to the switch. A locking member is receivable by the locking arm when the switch is in the open position to prevent movement of the operating lever, thereby locking the switch in the open position.

When the locking member is received by the locking arm, movement of the operating lever is prevented, thereby ensuring that the switch blades do not move or close. Preventing movement of the operating lever also precludes electrical arcing from occurring should the switch blade be accidentally moved too close to an electrical contact of the switch. Additionally, the locking member may be brightly colored to indicate to personnel on the ground that the switch has been locked in an open position and not to remove the locking member until proper authorization has been received.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring now to the drawings that form a part of the original disclosure.

DETAILED DESCRIPTION OF THE INVENTION

Figure 1:
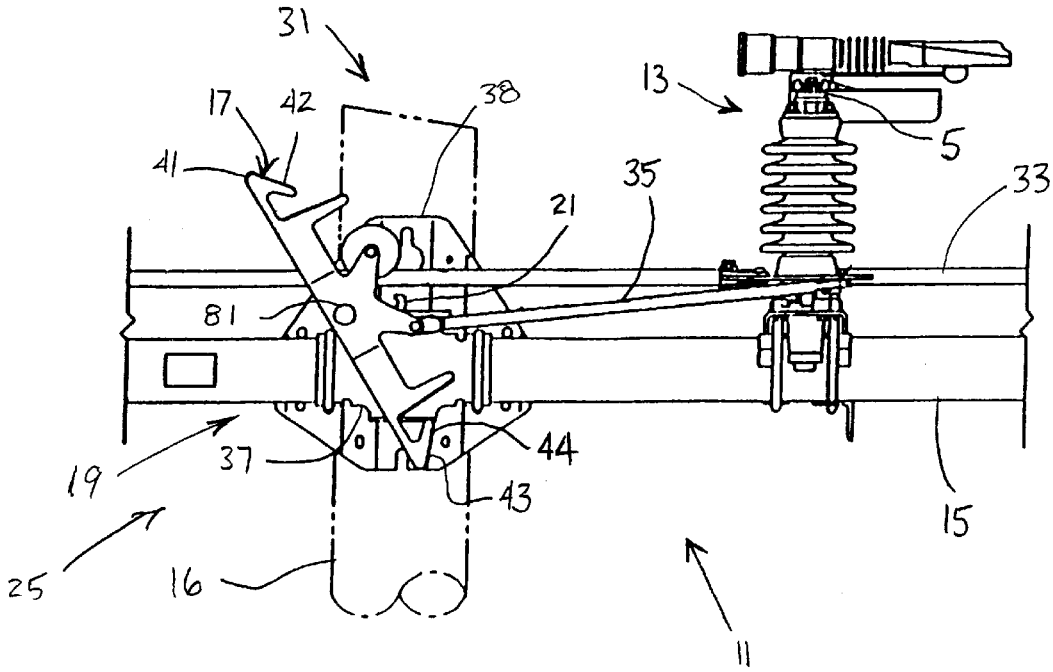
FIG. 1 is a front elevational view of a horizontally mounted switch assembly in a closed position having a locking assembly according to a first embodiment of the present invention.

As shown in FIGS. 1–18, the present invention relates to a locking assembly 19 for a hookstick operated switch assembly 11 mounted to a support 15 on a utility pole 16. A switch 13 of the switch assembly 11 is movable between open and closed positions. An operating lever 17 is connected to the switch 13 for opening and closing the switch. A locking arm 21 is positioned proximal the operating lever 17. A locking member 23 (FIG. 5) is receivable by the locking arm 21 when the switch is in the open position to prevent movement of the operating lever 17, thereby locking the switch 13 in the open position.

Figure 2:
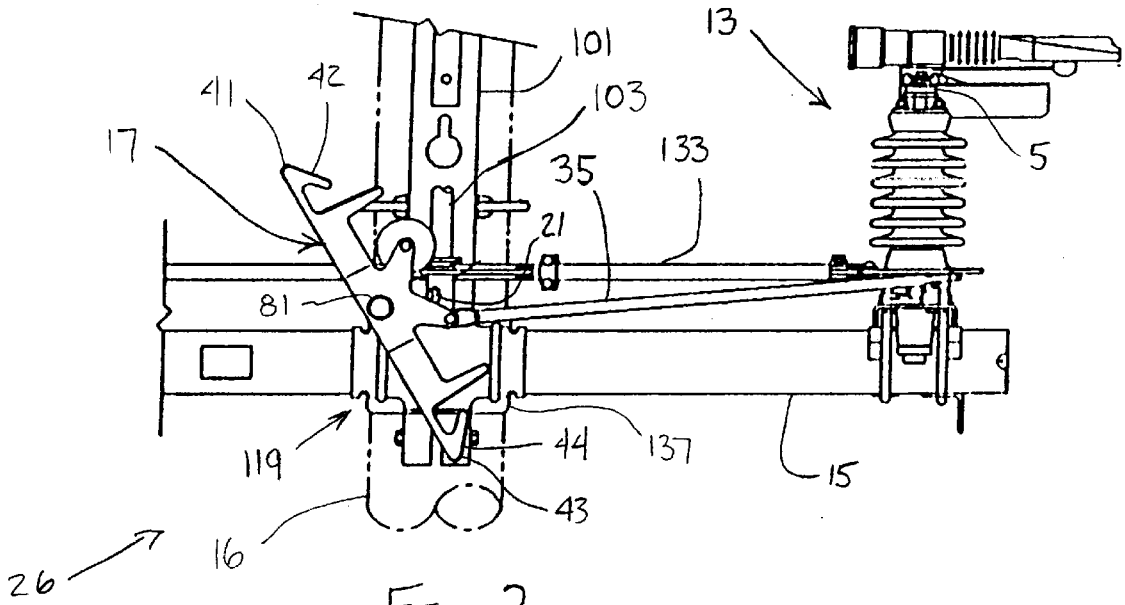
FIG. 2 is a front elevational view of a delta mounted switch assembly in a closed position having a locking assembly according to a first embodiment of the present invention.
Figure 3:
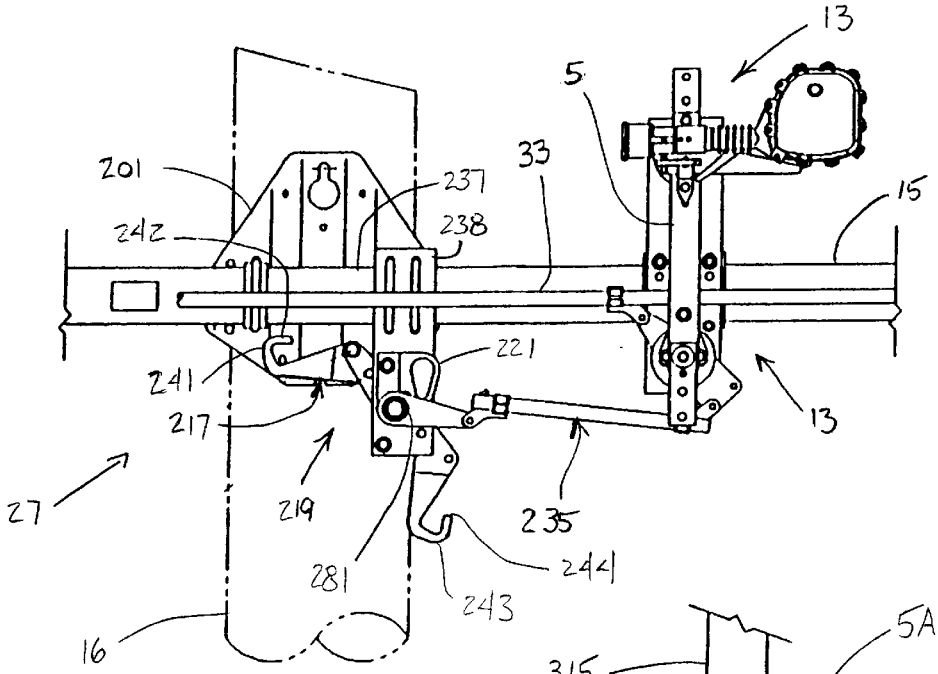
FIG. 3 is a front elevational view of a vertically mounted switch assembly in a closed position having a locking assembly according to a second embodiment of the present invention.
Figure 4:
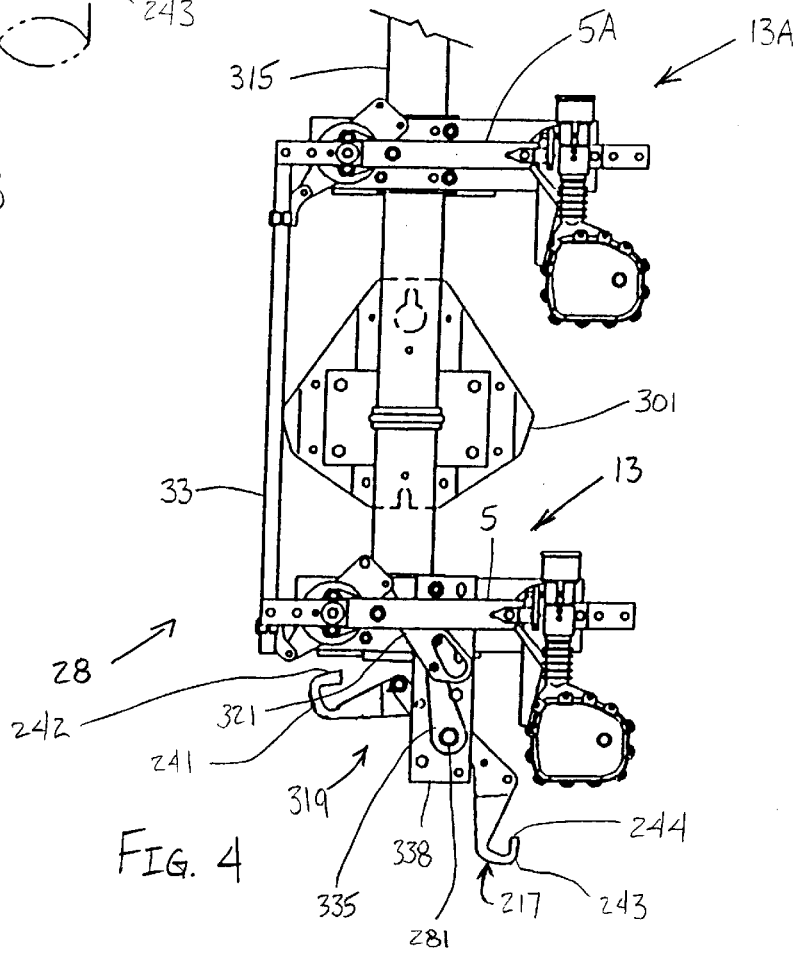
FIG. 4 is a front elevational view of a phase-over-phase mounted switch assembly in a closed position having a locking assembly according to a third embodiment of the present invention.

The locking assembly of the present invention may be used with a variety of variously configured switch assemblies. FIG. 1 shows a first embodiment of the present invention including a horizontally mounted switch assembly 25, i.e., the switch blades 5 rotate or pivot in a horizontal plane. FIG. 2 shows a second embodiment of the present invention including a delta mounted switch assembly 26 in which two switches are mounted on a first horizontal support and a third switch is mounted on a second horizontal support. FIG. 3 shows a third embodiment of the present invention including a vertically mounted switch assembly 27, i.e., the switch blades rotate or pivot in a vertical plane. FIG. 4 shows a fourth embodiment of the present invention including a phase-over-phase mounted switch assembly 28 in which the switches are mounted over one another on a vertical support.

A locking assembly 19 according to the first embodiment of the present invention is shown in use with a three phase horizontally mounted switch assembly 31 in FIG. 1. However, the locking assembly 19 according to the first embodiment of the present invention may be used with a switch assembly having any number of interconnected switches. The three phase horizontally mounted switch assembly 25, as shown in FIG. 1, has a horizontal support member 15 on which three horizontally mounted switches (i.e., the switch blades rotate in a horizontal plane) are mounted. One switch is the drive switch 13, and the remaining switches are driven by the drive switch. For reasons of simplicity, only the drive switch 13 is shown. A support bracket 37 is secured to the horizontal support member 15. A support plate 38 is attached to the utility pole 16 or other suitable support. The horizontal support member 15 is mounted on the utility pole 16 by securing the support bracket 37 to the support plate 38.

In the three phase horizontally mounted switch assembly 31, the two additional switches are connected to the drive switch 13 by a horizontally extending interphase shaft 33. Rotation of the drive switch 13 is transformed into lateral movement of the interphase shaft, such that the other two switches open and close simultaneously with the drive switch.

As shown in FIG. 1, during normal operation of the hookstick operated switch assembly 11, the switch 13 is in the closed position. Movement of the operating lever 17 opens and closes the switch 13. A hookstick (not shown) may be used by personnel on the ground to rotate the operating lever 17 counter-clockwise to open and clockwise to close the switch 13.

A reach rod 35 is connected between the operating lever 17 and the drive switch 13, as shown in FIG. 1. Rotation of the operating lever 17 around a pivot pin 81 results in lateral movement of the reach rod 35, which is translated into rotational movement of the switch 13 by the conventional mechanism. The rotation of the switch 13 causes the switch to open and close.

The locking assembly 19 according to the first embodiment of the present invention includes the operating lever 17, locking arm 21 and locking member 23, as shown in FIGS. 1, 2 and 5–10.

Figure 5:
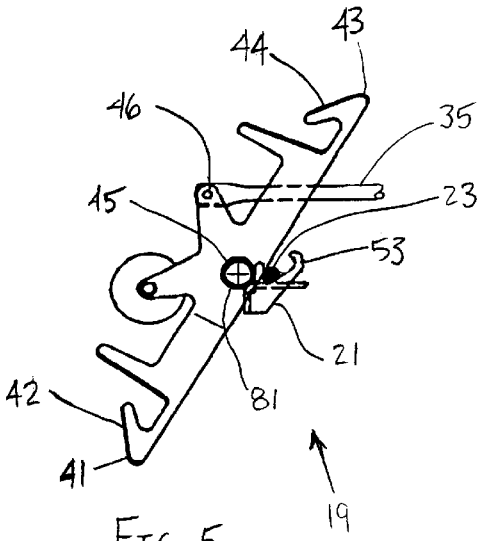
FIG. 5 is a front elevational view of a locking assembly according to the first embodiment of the present invention connected to the horizontally mounted switch assembly of FIG. 1 in an open position.
Figure 6:
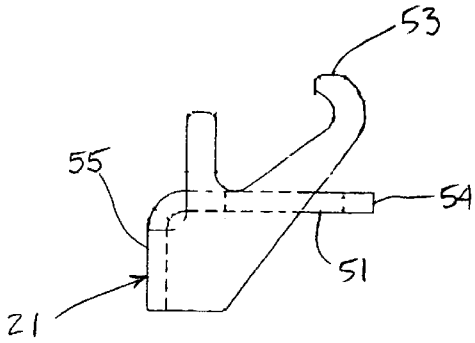
FIG. 6 is a front elevational view of the locking arm of FIG. 5.
Figure 7:
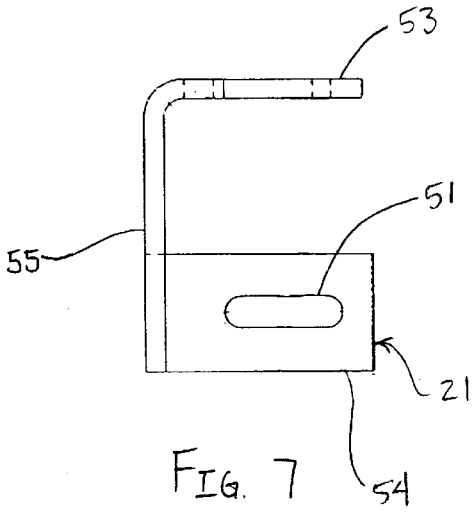
FIG. 7 is a bottom plan view of the locking arm of FIG. 5.
Figure 8:
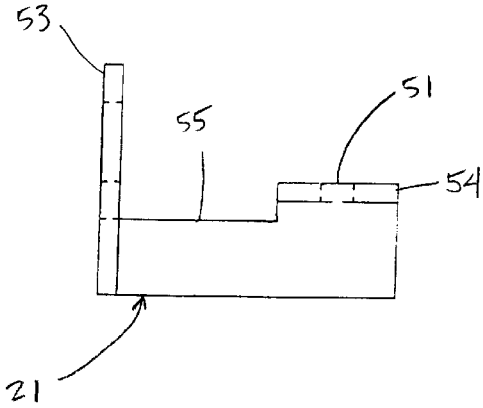
FIG. 8 is side elevational view of the locking arm of FIG. 5.
Figure 9:
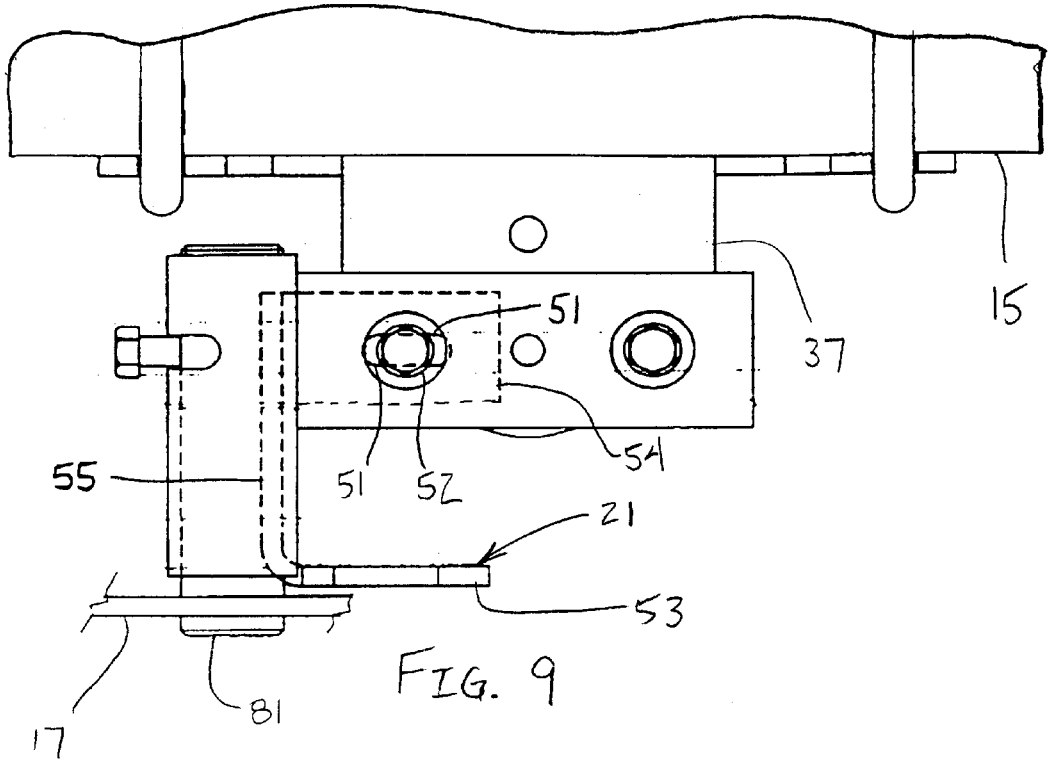
FIG. 9 is a top plan view of the locking arm assembly connected to the horizontally mounted switch assembly of FIG. 1.
Figure 10:
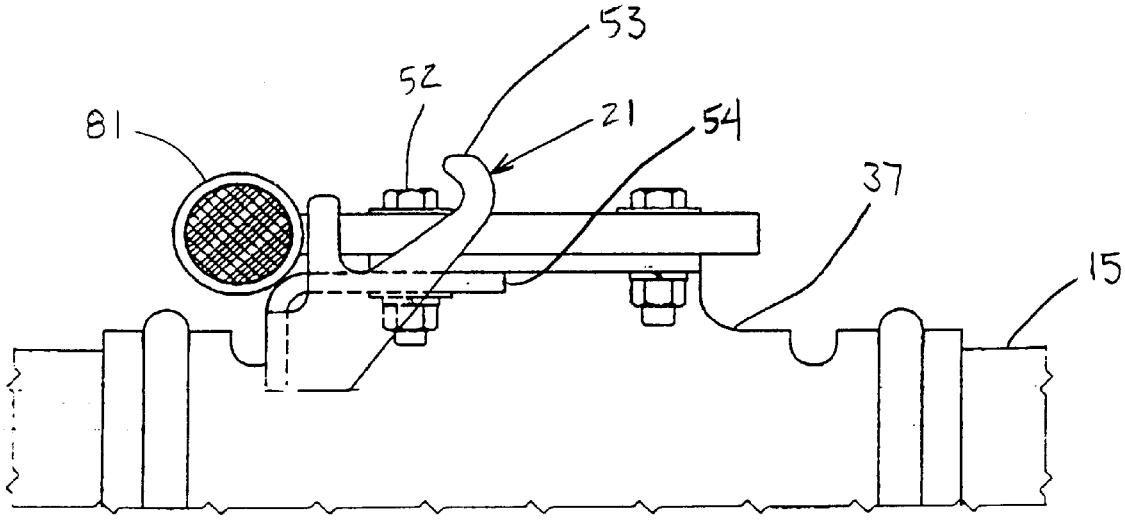
FIG. 10 is a front elevational view of the locking arm assembly connected to the horizontally mounted switch assembly shown in FIG. 9.
Figure 11:
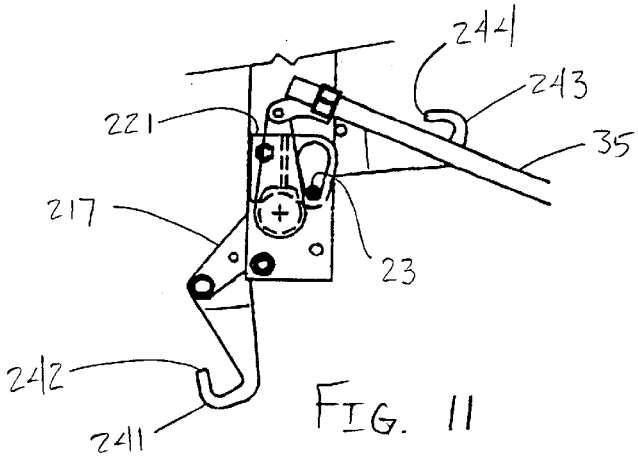
FIG. 11 is a front elevational view of a locking assembly according to the third embodiment of the present invention connected to the vertically mounted switch assembly of FIG. 3 in an open position.
Figure 12:
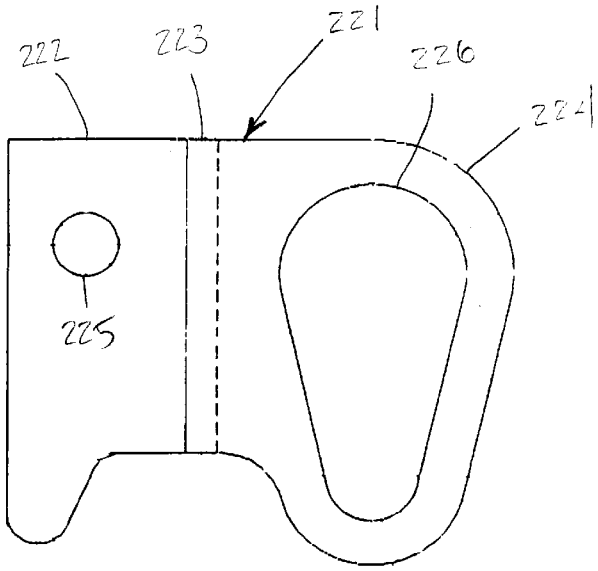
FIG. 12 is a front elevational view of the locking arm of FIG. 11.
Figure 13:
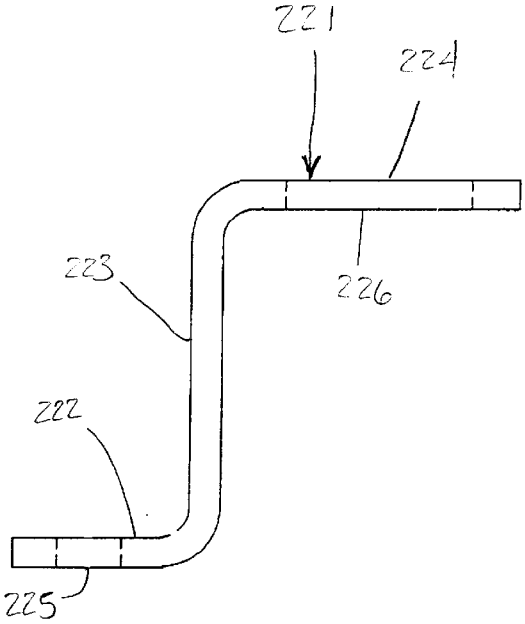
FIG. 13 is a side elevational view of the locking arm of FIG. 12.

The operating lever 17 has first and second ends 41 and 43, respectively, as shown in FIG. 5. A first hook 42 is located at the first end 41 and a second hook 44 is located at the second end 43. A hookstick (not shown) may be employed by personnel on the ground to change the position of the operating lever 17. The hookstick engages the first or second hook 42 or 44 to pull the drive switch 13 into an open or closed position, thereby opening or closing all the switches of the switch assembly 11. A first opening 45 in the operating lever 17 receives a pivot pin 81 to pivotally mount the operating lever to the support bracket 37. A second opening 46 in the operating lever 17 receives a fastener for connecting the operating lever to the reach rod 35 at a location spaced from pivot pin 81.

A locking arm 21 according to the first embodiment of the present invention is shown in FIGS. 6–10. The locking arm 21 has an attaching portion 54 for securing the locking arm to the switch assembly 11. A receiving portion 53 of the locking arm 21 receives the locking member 23. Preferably, the receiving portion 53 is substantially U-shaped. A connecting portion 55 joins the receiving and attaching portions 53 and 54 of the locking arm 21. Preferably, the connecting portion 55 is integral with the receiving and attaching portions 53 and 54. The locking arm 21 has a fastener hole 51 that receives a fastener 52 for securing the locking arm to the support bracket 37 on the support member 15. The receiving portion 53 receives the locking member 23 when the switch 13 is in the open position to prevent movement of the switch 13, thereby locking the switch in the open position.

The locking member 23 is received by the locking arm 21 when the switch is in the open position to prevent movement of the operating lever 17, as shown in FIG. 5. Preferably, the locking member 23 is brightly colored or differently colored from the switch assembly 11 for easy visibility of the locking member from the ground level, thereby providing a visual indication that the locking member is in place and that the switch assembly has been locked in an open position. The locking member 23 may be installed from the ground with a hookstick. Alternatively, the locking member 23 may be attached to the switch assembly 11 with an elongated flexible member 79 for hand installation. Preferably, the locking member 23 is made of a flexible material, such as plastic.

Figure 16:
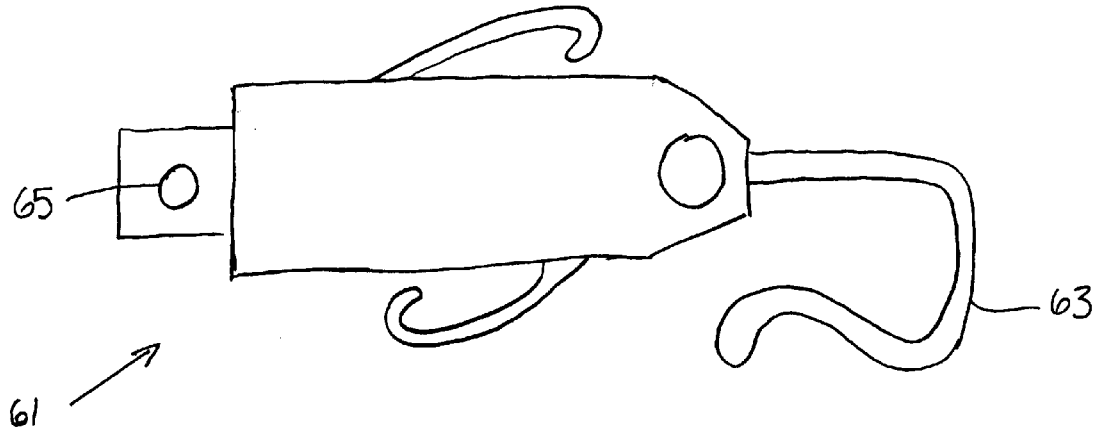
FIG. 16 is a top plan view of a first locking member for the locking assembly of the present invention.
Figure 17:
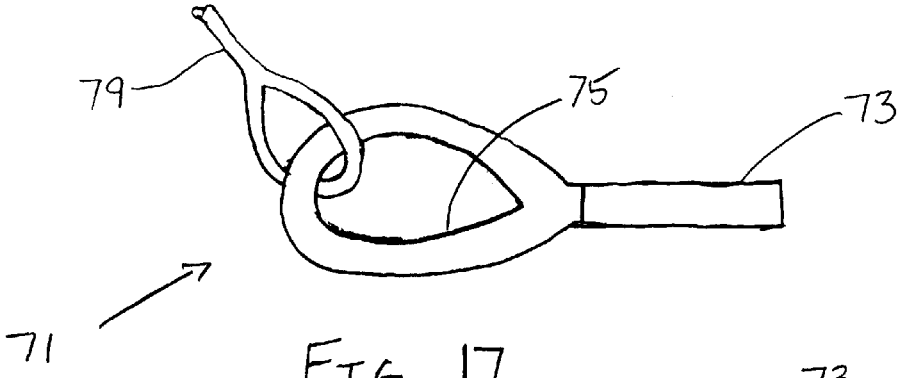
FIG. 17 is a top plan view of a second locking member for the locking assembly of the present invention.
Figure 18:
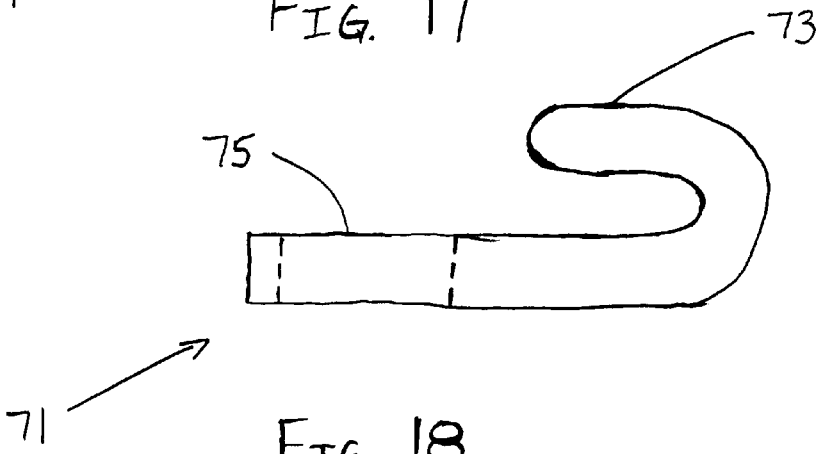
FIG. 18 is a front elevational view of the second locking member of FIG. 17.

The locking member 23 may be of any suitable configuration, such as the first hook device 61 shown in FIG. 16 and the second hook device 71 shown in FIGS. 17 and 18. The first hook device 61 has an opening 65 for receiving a hasp on a hookstick or an elongated flexible member. The first hook device 61 may then be positioned with the hookstick so that the hook 63 is received by the receiving portion 53 of the locking arm 21. Once the first hook device 61 has been received by the locking arm 21, the operating lever 17 is prevented from moving by the presence of the first hook device in the locking arm 21.

The second hook device 71 has an opening 75 for receiving a hasp on a hookstick. The second hook device 71 may then be positioned with the hookstick so that the hook 73 is received by the receiving portion 53 of the locking arm 21. Once the second hook device 71 has been received by the locking arm 21, the operating lever 17 is prevented from moving by the presence of the second hook device in the locking arm 21. Alternatively, opening 75 may receive an elongated flexible member 79, as shown in FIG. 17, which attaches the second hook device to the horizontally mounted switch assembly 25. The second hook device 71 may then be inserted in the receiving portion 53 of the locking arm 21 by hand.

Assembly and Disassembly

As shown in FIG. 1, the horizontally mounted switch assembly 31 is shown in a closed position. In the closed position, the first hook 42 of the operating lever is above the second hook 44, although any orientation of the operating lever may be used. A hookstick, or any other suitable device, is used to engage the first hook 42 of the operating lever 17. Once the hookstick has engaged the first hook 42, the operating lever 17 is pulled downward with the hookstick so that the first hook 42 is now below the second hook 44, as shown in FIG. 5. The counter-clockwise rotation of the operating lever about pivot pin 81 moves reach rod 35. The lateral movement of the reach rod 35 is transformed into rotation of the switch 13, thereby opening switch 13. The rotation of the switch 13 is transformed into lateral movement of the interphase shaft 33, which, in turn, is transformed into rotational movement of each of the other switches connected to the interphase shaft, thereby opening all the switches simultaneously.

Once the operating lever 17 has been moved to open the switch 13, a locking member 23 is inserted into the receiving portion 53 of the locking arm, such as the first or second hook devices 61 or 71. The hasp of a hookstick engages the openings 65 or 75 of the first or second hook devices 61 or 71, respectively. The first or second hook device is then positioned with the hookstick so that the hook 63 or 73, respectively, is received by the receiving portion 53 of the locking arm 21. Once the first or second hook device 61 or 71 has been received by the locking arm 21, the operating lever 17 is prevented from moving or pivoting clockwise by the first or second hook device, thereby locking the switch in a fully open position. The operating lever 17 cannot be moved back to its initial position, as shown in FIG. 1, until the locking member 23 is removed from locking arm 21, thereby preventing closing or near closing of the switches. Alternatively, the locking member 23 may be attached by an elongated flexible member 79 such that the locking member may be installed by hand into the locking arm 21.

When it is desired to close the switch to return the switch assembly to its normal operating condition, the locking member 23 is removed from the locking arm 21. The locking member 23 may be removed with a hookstick or by hand. The operating lever 17 is now free to move. The hookstick engages the second hook 44 at the second end 43 of the operating lever 17 and pulls it downward, thereby returning the operating lever to its initial position, i.e., the first end 41 of the operating lever 17 being above the second end 43. The switches are closed in a similar manner to that in which the switches are opened.

Second Embodiment

The second embodiment of the present invention has a locking assembly 119 used with a conventional three phase delta mounted switch assembly 26, as shown in FIG. 2. The three phase delta mounted switch assembly 26 has two switches (only one switch is shown) mounted on the horizontal support 15 with a third switch (not shown) mounted on the support plate 101 on the utility pole 16 at a higher elevation. A support bracket 137 is secured to the horizontal support member 15. A support plate 101 is mounted on the pole 16. The support bracket 137 is secured to the support plate 101 to mount the horizontal support member to the utility pole 16.

The operating lever 17, locking arm 21 and locking member 23 are identical to those of the first embodiment. The operating lever is connected to the switch 13 by the reach rod 35. The second switch mounted on the horizontal support member 15 is connected to the drive switch 13 by a first interphase shaft 133. A second interphase shaft 103 is rotationally connected to the first interphase shaft 133. Lateral movement of the first interphase shaft 133 causes the second interphase shaft 103 to rotate. The third switch is operationally connected to the second interphase shaft 103, such that rotation of the second interphase shaft causes the third switch to open and close. Therefore, all three switches of the delta mounted switch assembly 26 open and close in unison.

The locking assembly 119 of the second embodiment is identical to that of the first embodiment.

Third Embodiment

The third embodiment of the present invention has a locking assembly 219 used with a conventional three phase vertically mounted switch assembly 27, as shown in FIG. 3. The three phase vertically mounted switch assembly 27 has three switches (only one switch is shown) mounted on the horizontal support 15. The switch blades 5 of the switches of the vertically mounted switch assembly 27 rotate in a vertical plane. A support bracket 237 is secured to the horizontal support member 15. A support plate 201 is mounted on the pole 16. The support bracket 237 is secured to the support plate 201 to mount the horizontal support member to the utility pole 16.

The locking assembly 219 according to the third embodiment of the present invention includes the operating lever 217, locking arm 221 and locking member 23, as shown in FIGS. 3 and 11–13.

The operating lever 217 has first and second ends 241 and 243, respectively. A first hook 242 is located at the first end 241 and a second hook 244 is located at the second end 243. A hookstick (not shown) may be employed by personnel on the ground to change the position of the operating lever 217. The hookstick engages the first or second hook 242 or 244 to rotate the operating lever 217 counter-clockwise to rotate the drive switch 13 clockwise into an open position or rotates the operating lever 217 clockwise to rotate the drive switch 13 counter-clockwise into a closed position, thereby opening or closing all the switches of the switch assembly 27 simultaneously. An opening in the operating lever 217 receives a pivot pin 281 to pivotally mount together the operating lever 217 and the reach rod 235 and to the support clamp 238. The support clamp 238 is attached to the support bracket 237.

The locking arm 221 according to the third embodiment of the present invention is shown in FIGS. 3 and 11–13. The locking arm 221 has an attaching portion 222 having a first opening 225 for securing the locking arm to the support clamp 238. A receiving portion 224 of the locking arm 221 has a second opening 226 for receiving the locking member 23. Preferably, the second opening 226 is substantially tear-dropped shaped. A connecting portion 223 joins the receiving and attaching portions 222 and 224 of the locking arm 221. Preferably, the connecting portion 223 is integral with the receiving and attaching portions 222 and 224. Preferably, the connecting portion 223 extends perpendicularly from the attaching portion 222, and the receiving portion extends perpendicularly from the connecting portion 223 in a direction opposite to the attaching portion. The second opening 226 receives the locking member 23 to prevent clockwise pivoting movement of the switch 13, thereby locking the switch in the fully open position.

Opening, locking and closing the switches is operationally identical to the first embodiment of the present invention discussed above.

Fourth Embodiment

The fourth embodiment of the present invention has a locking assembly 319 that is used with a conventional phase-over-phase mounted switch assembly 28, as shown in FIG. 4. The phase-over-phase switch assembly 28 has at least two switches 13 and 13A, each of which are mounted at different elevations on a vertical support 315. As many switches as required may be added at different elevations to the phase-over-phase switch assembly 28. The switch blades 5 and 5A of the switches rotate in a vertical plane. The phase-over-phase switch assembly 28 has at least two switches 13 and 13A mounted on the vertical support 315. The vertical support 315 is attached to a support plate 301 to mount the phase-over-phase switch assembly 28 to a support, such as a utility pole (not shown).

Figure 14:
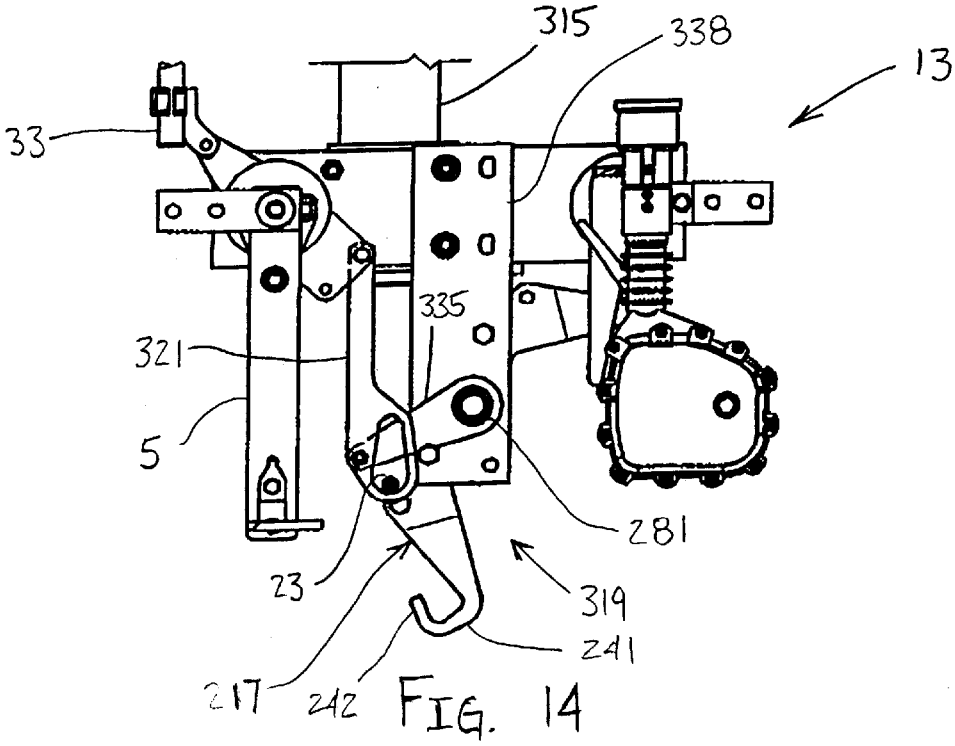
FIG. 14 is a front elevational view of a locking assembly according to the fourth embodiment of the present invention connected to the phase-over-phase mounted switch assembly of FIG. 4 in an open position.
Figure 15:
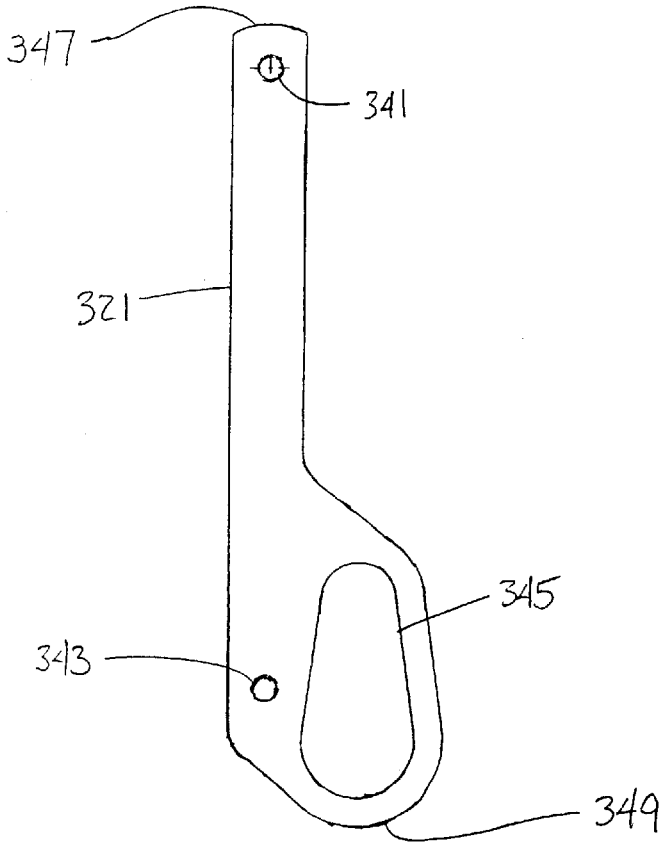
FIG. 15 is a front elevational view of the locking arm of FIG. 14.

The locking assembly 319 according to the fourth embodiment of the present invention includes the operating lever 217, locking arm 321 and locking member 23, as shown in FIGS. 4, 14 and 15.

The operating lever 217 is identical to that of the third embodiment, discussed above. An opening in the operating lever 217 receives a pivot pin 281 to pivotally connect the operating lever 217 and the pivot arm 335 and to mount them to the support clamp 338. The support clamp 338 is attached to the switch 13.

The locking arm 321 according to the fourth embodiment of the present invention is shown in FIGS. 4, 14 and 15. The locking arm 321 has first, second and third openings 341, 343 and 345, respectively. The first opening 321 is proximal a first end 347 of the operating lever 321. The second and third openings 343 and 345 are proximal a second end 349 of the operating lever 321. The first opening 341 receives a fastener for pivotally connecting the locking arm to the switch 13. The second opening 343 receives a fastener for pivotally connecting the locking arm to the pivot arm 335. The third opening 345 receives the locking member 23 when the switch 13 is the open position, as shown in FIG. 14, thereby locking the switch in the fully open position. The locking member 23 may be engaged with the third opening 345 of the locking arm 321 by a hookstick or by hand. By preventing movement of the operating lever, movement of the switch blades is thereby prevented, which also eliminates the occurrence of electrical arcing should the switch blades get close to the electrical contacts of the switches.

When the switches 13 and 13A are in the closed position (i.e., switch blades 5 and 5A are closed), the first hook 242 is above the lower hook 243 of the operating lever 217. A hookstick is used to engage the first hook 242 of the operating lever 217 and to then pull the operating lever downward. The rotation counter-clockwise of the operating lever 217 is transferred through the pivot pin 281 to the pivot arm 335. The pivot arm 335 is pivotally connected to the locking arm 321, so that the rotation of the pivot arm is transformed into lateral movement of the locking arm. The movement of the locking arm 321, in turn, rotates the switch 13, thereby opening the switch by rotating the switch blade 5, as shown in FIG. 14. The switch 13 is connected to an interphase shaft 33 so that the rotation of the switch results in lateral movement of the interphase shaft. Second switch 13A is also connected to the interphase shaft 33, such that the lateral movement of the interphase shaft results in corresponding rotation of the second shaft. Therefore, movement of the operating lever 217 results in corresponding rotation of all the switches that make up the phase-over-phase switch assembly 28.

When the switches have been fully opened, as shown in FIG. 14, the first hook 242 is lower than the second hook 244. The locking member 23 may then be inserted into the third opening 345 of the locking arm 321 to lock the switches in the fully open position. The locking member 23 positioned in the third opening 345 prevents clockwise rotational movement of the pivot arm 335, thereby locking the switches open. The locking member 23 becomes wedged between the pivot arm 335 and the operating lever 217 if someone attempts to pull the operating lever 217 downward to close the switches, thereby locking the switches in the open position. The locking member 23 may be installed by a hookstick or by hand, as discussed above.

To return the phase-over-phase mounted switch assembly 28 to normal operating position (i.e., switches closed) as shown in FIG. 4, the locking member 23 must first be removed from the third opening 345 of the locking arm 321, which may be accomplished with a hookstick or by hand. The hookstick may then be used to engage the second hook 244 of the operating lever 217 to pull the operating lever downward. Closing the switches operates equivalently to opening the switches, as discussed above.

While advantageous embodiments have been chosen to illustrate the invention, it will be understood by those skilled in the art that various changes and modifications may be made therein without departing from the scope of the invention as defined in the appended claims.

What is claimed is:

1. A hookstick operated switch assembly, comprising:

a switch mounted to a support and movable between open and closed positions;

an operating lever connected to said switch for opening and closing said switch;

a locking arm positioned proximal said operating lever; and a locking member receivable by said locking arm when said switch is in said open position to prevent movement of said operating lever and thereby locking said switch in said open position.

2. A hookstick operated switch assembly according to claim 1, wherein said switch assembly is a horizontally mounted switch assembly.

3. A hookstick operated switch assembly according to claim 1, wherein said switch assembly is a vertically mounted switch assembly.

4. A hookstick operated switch assembly according to claim 1, wherein said switch assembly is a delta mounted switch assembly.

5. A hookstick operated switch assembly according to claim 1, wherein said switch assembly is a phase-over-phase mounted switch assembly.

6. A hookstick operated switch assembly according to claim 1, wherein said locking arm has a substantially U-shaped portion for receiving said locking member.

7. A hookstick operated switch assembly according to claim 1, wherein said locking arm has an opening for receiving said locking member.

8. A hookstick operated switch assembly according to claim 1, wherein said locking member is a hook.

9. A hookstick operated switch assembly according to claim 1, wherein said locking device is brightly colored for easy visibility.

10. A hookstick operated switch assembly according to claim 1, wherein said locking device is differently colored than said hookstick operated switch assembly to make said locking device easily visible.

11. A hookstick operated switch assembly according to claim 1, wherein said locking device is attached to said switch with an elongated flexible member.

12. A hookstick operated switch assembly, comprising:

a switch mounted to a support and movable between open and closed positions;

an operating lever connected to said switch for opening and closing said switch;

a locking arm having a substantially U-shaped portion attached to said support; and a locking member receivable by said substantially U-shaped portion of said locking arm when said switch is in said open position to prevent movement of said operating lever and thereby locking said switch in said open position.

13. A hookstick operated switch assembly according to claim 12, wherein said switch assembly is a horizontally mounted switch assembly.

14. A hookstick operated switch assembly according to claim 12, wherein said switch assembly is a delta mounted switch assembly.

15. A hookstick operated switch assembly according to claim 12, wherein said locking member is brightly colored for easy visibility.

16. A hookstick operated switch assembly according to claim 12, wherein said locking member is differently colored than said hookstick operated switch assembly to make said locking device easily visible.

17. A hookstick operated switch assembly according to claim 12, wherein said locking member is attached to said switch with an elongated flexible member.

18. A hookstick operated switch assembly, comprising:

a switch mounted to a support and movable between open and closed positions;

an operating lever for opening and closing said switch;

a locking arm having an opening attached to said operating lever; and a locking member receivable by said opening in said locking arm when said switch is in said open position to prevent movement of said operating lever and thereby locking said switch in said open position.

19. A hookstick operated switch assembly according to claim 18, wherein said switch assembly is a vertically mounted switch assembly.

20. A hookstick operated switch assembly according to claim 18, wherein said locking member is a hook.

21. A hookstick operated switch assembly according to claim 18, wherein said locking member is brightly colored for easy visibility.

22. A hookstick operated switch assembly according to claim 18, wherein said locking member is differently colored than said hookstick operated switch assembly to make said locking device easily visible.

23. A hookstick operated switch assembly according to claim 18, wherein said locking member is attached to said switch with an elongated flexible member.

24. A hookstick operated switch assembly, comprising:

a switch mounted to a support and movable between open and closed positions;

an operating lever for opening and closing said switch;

a locking arm having an opening attached to said operating lever, said locking arm being connected at a first end to said operating lever and at a second end to said switch; and a locking member receivable by said opening in said locking arm when said switch is in said open position to prevent movement of said operating lever and thereby locking said switch in said open position.

25. A hookstick operated switch assembly according to claim 24, wherein said switch assembly is a phase-over-phase mounted switch assembly.

26. A hookstick operated switch assembly according to claim 24, wherein said locking member is a hook.

27. A hookstick operated switch assembly according to claim 24, wherein said locking member is brightly colored for easy visibility.

28. A hookstick operated switch assembly according to claim 24, wherein said locking member is differently colored than said hookstick operated switch assembly to make said locking member easily visible.

29. A hookstick operated switch assembly according to claim 24, wherein said locking member is attached to said switch with an elongated flexible member.

* * * * *